US011009023B2

(12) United States Patent
Kraige et al.

(10) Patent No.: US 11,009,023 B2
(45) Date of Patent: May 18, 2021

(54) HYDRAULIC FRACTURING DISTRIBUTION MANIFOLD

(71) Applicant: KCF TECHNOLOGIES, INC., State College, PA (US)

(72) Inventors: David R. Kraige, State College, PA (US); Gary H. Koopmann, Alexandria, VA (US); Jeremy E. Frank, Pine Grove Mills, PA (US); Blake T. Bonfanti, Argyle, TX (US)

(73) Assignee: KCF TECHNOLOGIES, INC., State College, PA (US)

( * ) Notice: Subject to any disclaimer, the term of this patent is extended or adjusted under 35 U.S.C. 154(b) by 0 days.

(21) Appl. No.: 16/383,568

(22) Filed: Apr. 12, 2019

(65) Prior Publication Data

US 2020/0325893 A1 Oct. 15, 2020

(51) Int. Cl.

| | |
|---|---|
| ***E21B 33/068*** | (2006.01) |
| ***E21B 43/26*** | (2006.01) |
| ***F04B 15/02*** | (2006.01) |
| ***F04B 53/16*** | (2006.01) |

(52) U.S. Cl.

CPC ..... *F04B 53/16* (2013.01); *E21B 33/068* (2013.01); *E21B 43/26* (2013.01); *F04B 15/02* (2013.01)

(58) Field of Classification Search

CPC ..... E21B 33/068; E21B 43/26; F04B 15/02; F04B 53/16

See application file for complete search history.

(56) References Cited

U.S. PATENT DOCUMENTS

| | | | | |
|---|---|---|---|---|
| 9,568,138 | B2 * | 2/2017 | Arizpe | E21B 41/00 |
| 2017/0122060 | A1 * | 5/2017 | Dille | B60P 3/2205 |
| 2017/0123437 | A1 * | 5/2017 | Boyd | G05D 16/04 |
| 2017/0130885 | A1 * | 5/2017 | Arizpe | F16L 55/035 |
| 2018/0179848 | A1 * | 6/2018 | Cherewyk | E21B 17/05 |
| 2018/0223640 | A1 * | 8/2018 | Keihany | F16L 41/03 |

* cited by examiner

*Primary Examiner* — Matthew R Buck
(74) *Attorney, Agent, or Firm* — MH2 Technology Law Group LLP

(57) ABSTRACT

A distribution manifold includes a main trunk line at a first end of the manifold proximate a boost pump, two branch lines at a downstream end of the main trunk line, a first Y-connector coupling upstream ends of the two branch lines to the downstream end of the main trunk line, two sub-branch lines at a downstream end of each of the two branch lines, and two second Y-connectors coupling upstream ends of the four sub-branch lines to the downstream ends of the two respective branch lines. A sum of cross-sectional areas of downstream ends of the four sub-branch lines is equal to the cross-sectional area of the upstream end of the main trunk line.

18 Claims, 4 Drawing Sheets

HYDRAULIC FRACTURING DISTRIBUTION MANIFOLD

CROSS-REFERENCE TO RELATED APPLICATION

This nonprovisional application claims the benefit of U.S. Provisional Application No. 62/656,712, filed Apr. 12, 2018. The disclosure of the prior application is hereby incorporated by reference herein in its entirety.

BACKGROUND

Hydraulic fracturing is often used to produce oil and gas in an economic manner from low permeability reservoir rocks. Hydraulic fracturing increases rock permeability by opening channels through which hydrocarbons can flow to recovery wells. During hydraulic fracturing, a fluid carrying proppants in suspension is pumped into the earth under high pressure where it enters a reservoir rock and fractures it, thereby opening and widening channels for oil and gas to flow.

Specialized positive-displacement piston pumps are used to develop the pressures necessary for hydraulic fracturing or "fracking." These pumps typically include fluid ends within the body of which reciprocating plungers place fluids under pressure and valves control fluid flow to and from the plungers. These pumps also include a suction manifold that provides a flow of fluid to the body of the fluid end.

Positive-displacement piston pumps suffer from cavitation when exposed to poor suction conditions on the inlet side of the pump. Chronic cavitation of a pump leads to an extreme reduction in its service life, and can cause extremely early component failure, possibly leading to external leaks and safety concerns with uncontained high-pressure fluid. Hydraulic equipment industry guidelines exist for providing proper suction piping to the inlet of a positive-displacement pump to avoid this issue; however, practical concerns frequently make it difficult for the suction piping to adhere to these ideal guidelines.

A standard practice in hydraulic fracturing is to use a single boost pump (blender) to pressurize a slurry comprised of water, chemicals, and proppant (sand), and then supply that slurry to a group (normally 10-20) of positive displacement reciprocating piston pumps at a nominal pressure, on the order of 100 PSI. These system pumps then operate in parallel with one another to further raise the pressure to the order of thousands of PSI and pump the fluid downhole into the well. Ideally each of the system pumps receives equal suction pressure and flow from the boost pump and therefore operates in a healthy manner and contributes equally to the well stimulation process. In reality, the distribution of slurry from the boost pump to the system pumps is quite challenging due to the physical layout of a well site, including the fact that the pumps are mounted on tractor trailers. The system pumps are general located at variable distances from the boost pump, with some being very close and others being up to several hundred feet away. Achieving a uniform flow distribution between all these pumps is therefore difficult, but is essential to maintaining healthy suction conditions at all pumps, and maintaining a balanced operation across the entire site for good overall well stimulation performance.

Traditional distribution manifolds, which have largely been governed by practical concerns such as ease of construction and transit from one site to another rather than by proper hydraulic pumping design principles, have had a number of shortcomings, including:

- being undersized for the desired system pump flow rate, thus limiting the rate at which well stimulation can be performed and risking system pump cavitation;
- using extremely tight pipe bend radii and large bend angles, introducing flow restrictions;
- featuring sudden changes in pipe diameter, resulting in sudden changes in slurry velocity;
- being improperly sized such that velocity is not consistent throughout, leading to some sections where velocity is too high and there is a risk of pump cavitation, and other areas where velocity is too low and there is a risk of proppant fallout and clogging ("sanding off");
- providing non-uniform suction pressure conditions to the system pumps; generally providing lower suction pressure to those pumps located at greater distance from the boost pump; and/or
- providing non-uniform velocity conditions at ports for system pumps; generally having very high velocities at proximal ports and decreasing velocity at distal ports as the number of pumps drawing from the trunk line decreases.

FIG. 1 illustrates a traditional 10-port manifold design 100. The inlets 110 on the left side of FIG. 1 accept flow from a boost pump 105 and distribute the flow to ten pumps 190 (only five pumps 190 shown in FIG. 1 for clarity) at the ports 120, which are mostly oriented at 90 degrees to the trunk lines 115. Each of the pumps 190 may be, for example, a five-cylinder positive-displacement piston pump such as those described, for example, in co-pending U.S. patent application Ser. No. 16/248,728, filed on Jan. 15, 2019, which is incorporated herein by reference. The trunk lines 115 have a constant cross-section throughout their length. The velocity contours shown illustrate that velocity is very high on the left (proximal end) of the manifold where ten system pumps' worth of fluid is flowing, and velocity decreases to the right (distal end) as fewer and fewer pumps are drawing from the constant cross-section trunk lines 115.

It may be desirable to provide a distribution manifold that provides a more uniform flow and pressure inlet condition at each system pump location along the length of the manifold, thereby making it attainable to instrument the manifold, monitor the now-smaller variations in flow conditions at each system pump port, and adjust the pump RPM or gear to balance flow across the entire system pump fleet. In this regard, it may be desirable to provide a distribution manifold that (i) maintains a constant total cross-section from proximal to distal end, thus achieving constant velocity throughout, (ii) is properly sized to support correct volume flow rates and linear slurry velocities for time-efficient hydraulic fracturing operation without risking proppant fallout or exceeding safe pipe flow rates, (iii) is properly sized to match the suction port size of the system pumps without restricting flow, (iv) eliminates pipe bends of greater than 45-degrees, and/or (v) is optimized for construction on a standard highway tractor trailer such that it can be moved from well site to well site without disassembly. In some embodiments, it may be desirable to provide a distribution manifold that is broken up into 4-pump subsystems such that it can be adapted to larger or smaller well sites requiring different flow rates or total horsepower.

SUMMARY

According to various aspects of the disclosure, a hydraulic fracturing distribution manifold includes a plurality of pump subsystems, each of the pump systems being configured to direct a flow of hydraulic fracturing fluid to a plurality of positive displacement pumps. Each of the pump systems includes a main trunk line at a first end of the manifold proximate a boost pump, the main trunk line being configured to receive the flow from the boost pump, two branch lines at a downstream end of the main trunk line, a first Y-connector coupling the upstream ends of the two branch lines to the downstream end of the main trunk line, two sub-branch lines at a downstream end of each of the two branch lines, and two second Y-connectors coupling the upstream ends of the four sub-branch lines to the downstream ends of the two respective branch lines.

The main trunk line has a constant first cross-sectional area from an upstream end of the main trunk line to a downstream end of the main trunk line, each of the two branch lines has a constant second cross-sectional area from an upstream end of the branch line to a downstream end of the branch line, the first Y-connector is configured to split the flow from the main trunk line to the two branch lines, each of the four sub-branch lines has a constant third cross-sectional area from an upstream end of the sub-branch line to a downstream end of the sub-branch line, each of the sub-branch lines is configured to direct the flow to one of the positive displacement pumps, each of the second Y-connectors is configured to split the flow from one the two branch lines to two of the four sub-branch lines, and a sum of the third cross-sectional areas is equal to a sum of the two second cross-sectional areas and to the first cross-sectional area.

In some aspects of the disclosure, a distribution manifold includes a main trunk line at a first end of the manifold proximate a boost pump, two branch lines at a downstream end of the main trunk line, a first Y-connector coupling the two branch lines to the downstream end of the main trunk line, two sub-branch lines at a downstream end of each of the two branch lines, and a second Y-connector coupling the two sub-branch lines to the downstream end of the respective branch line.

The main trunk line is configured to receive a flow from the boost pump, the first Y-connector is configured to split the flow from the main trunk line to the two branch lines, each of the sub-branch lines is configured to direct the flow to one of a plurality of pumps, and the second Y-connector is configured to split the flow from the branch line to the two sub-branch lines.

The main trunk line has a cross-sectional area that is constant from an upstream end of the main trunk line to a downstream end of the main trunk line, the two branch lines have a total cross-sectional area that is constant from an upstream end of each of the two branch lines to a downstream end of each of the two branch lines, the four sub-branch lines have a total cross-sectional area that is constant from an upstream end of each of the four sub-branch lines to a downstream end of each of the four sub-branch lines, and the total cross-sectional area of the four sub-branch lines, the total cross-sectional area of the two branch lines, and the cross-sectional area of the main trunk line are equal to one another.

In accordance with various aspects, a distribution manifold includes a main trunk line at a first end of the manifold proximate a boost pump, two branch lines at a downstream end of the main trunk line, a first Y-connector coupling upstream ends of the two branch lines to the downstream end of the main trunk line, two sub-branch lines at a downstream end of each of the two branch lines, and two second Y-connectors coupling upstream ends of the four sub-branch lines to the downstream ends of the two respective branch lines.

The main trunk line is configured to receive a flow of fluid from the boost pump, an upstream end of the main trunk line having a cross-sectional area, the first Y-connector is configured to split the flow from the main trunk line to the two branch lines, each of the sub-branch lines is configured to direct the flow to one of a plurality of pumps, each of the second Y-connectors is configured to split the flow from one the two branch lines to two of the four sub-branch lines, and a sum of cross-sectional areas of downstream ends of the four sub-branch lines is equal to the cross-sectional area of the upstream end of the main trunk line.

DETAILED DESCRIPTION OF EMBODIMENTS

Figure 1:
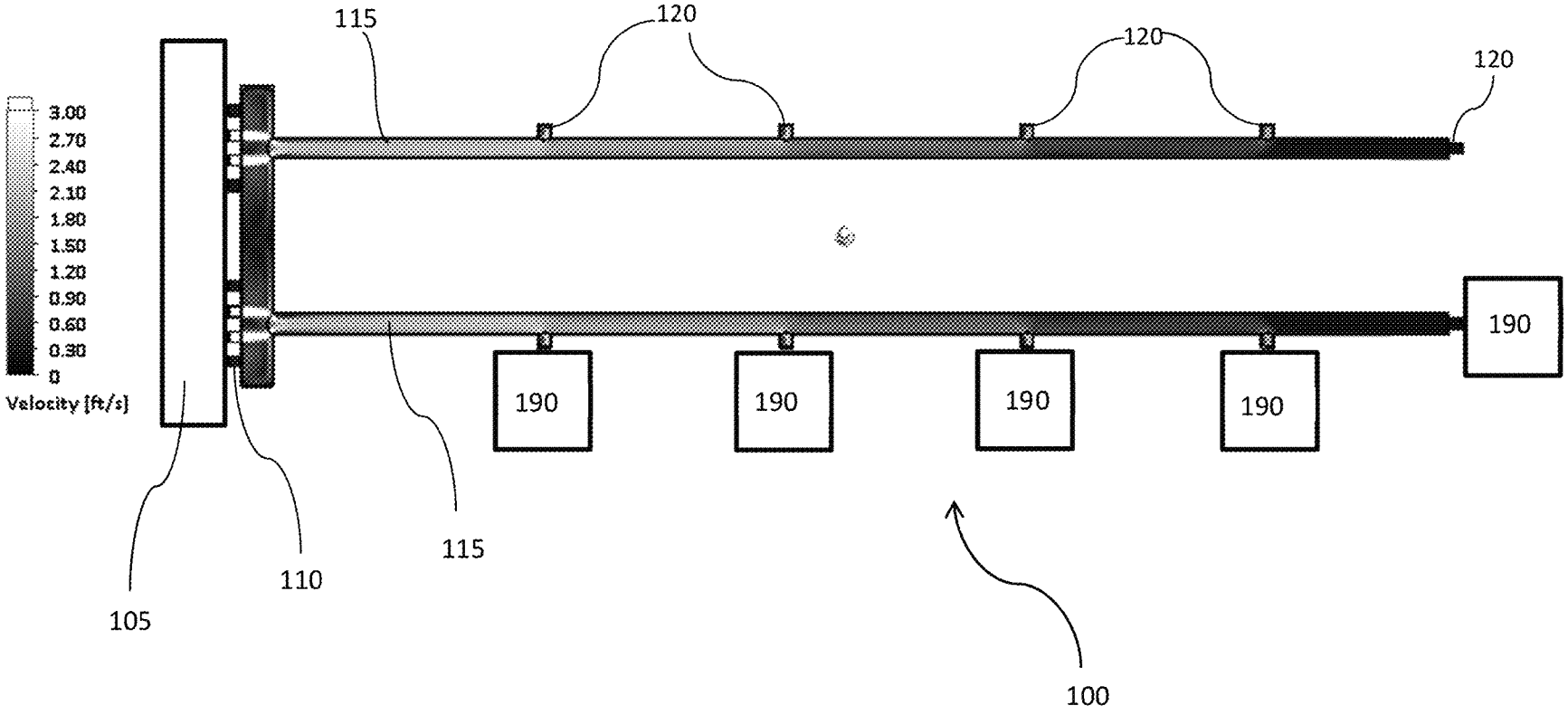
FIG. 1 is a top diagrammatic view of a distribution manifold having a conventional arrangement.
Figure 2:
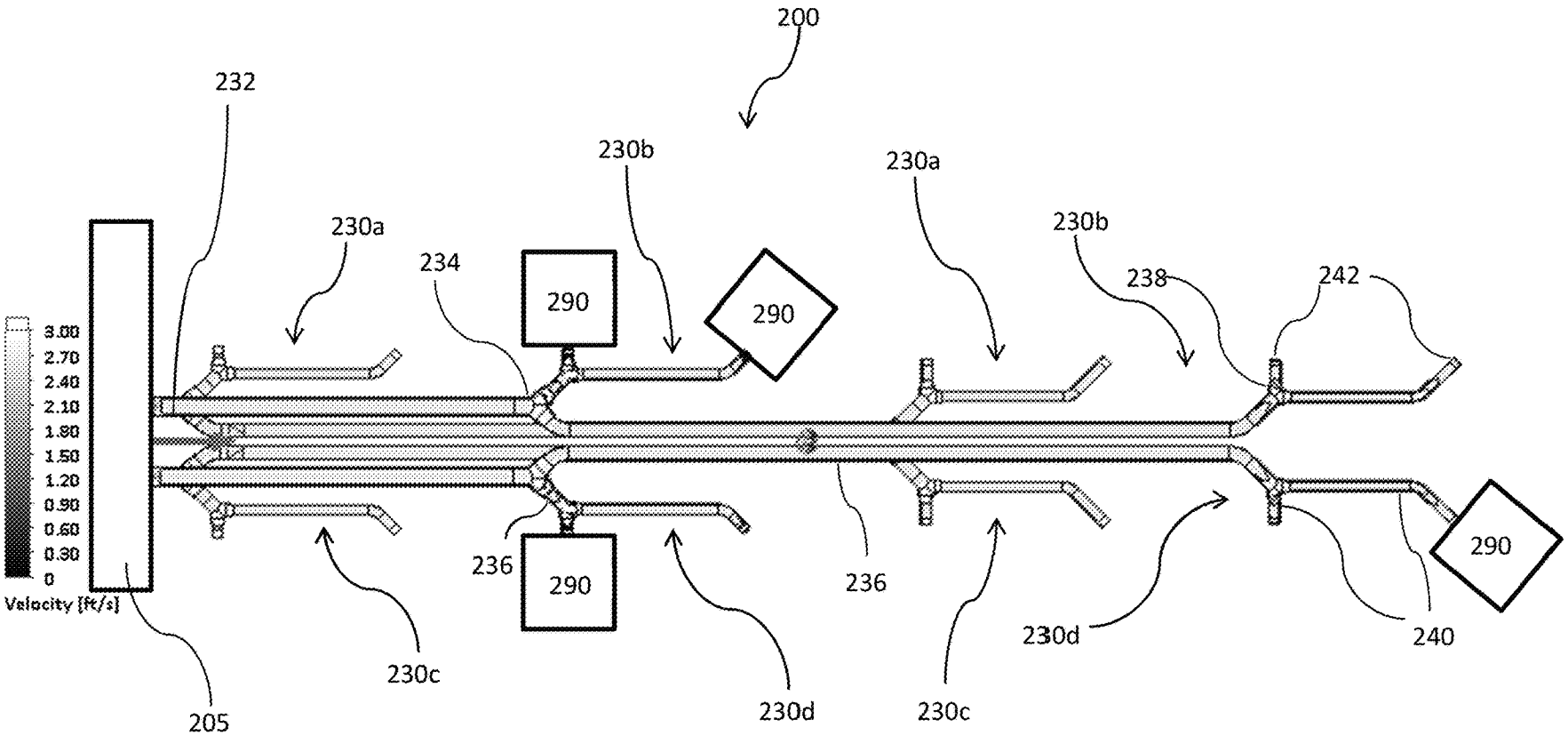
FIG. 2 is a top diagrammatic view of a distribution manifold in accordance with various aspects of the disclosure.
Figure 3:
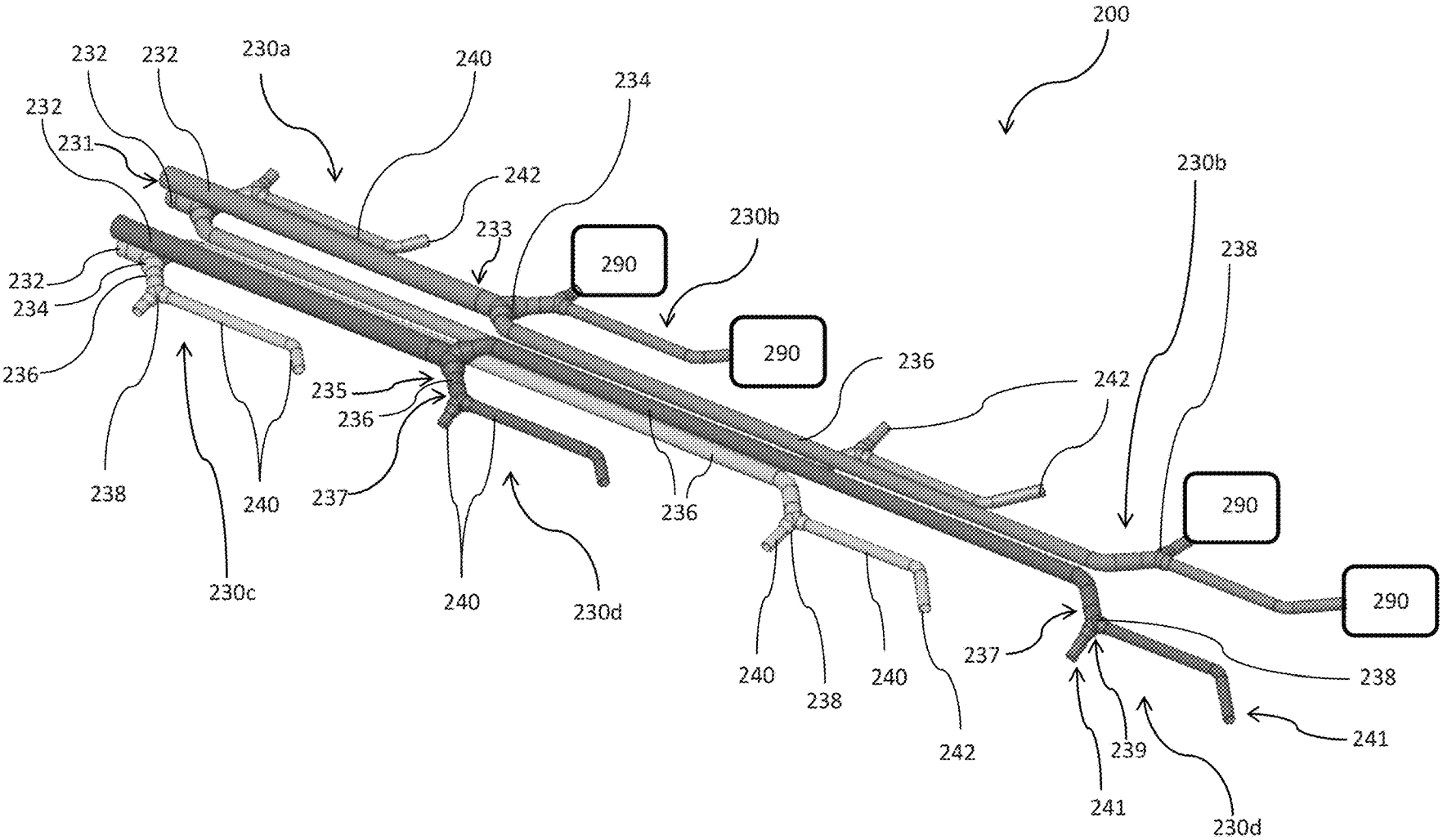
FIG. 3 is a perspective view of the distribution manifold of FIG. 2.

Referring to FIGS. 2 and 3, a distribution manifold 200 in accordance with various aspects of the disclosure is illustrated. The distribution manifold 200 is broken up into subsystems. For example, in the exemplary embodiment shown in FIGS. 2 and 3, the distribution manifold 200 includes four 4-pump subsystems 230*a*, 230*b*, 230*c*, 230*d*. Each subsystem 230*a*, 230*b*, 230*c*, 230*d* begins with a main trunk line 232 at a first end of the manifold proximate a boost pump 205 (i.e., left end in FIGS. 2 and 3). In the embodiment shown in FIGS. 2 and 3, each of the trunk lines 232 accepts flow from the boost pump 205 and distributes the flow to four pumps 290 (only one pump 290 shown in FIGS. 2 and 3 for clarity), which may be, for example, a five-cylinder positive-displacement piston pump such as those described, for example, in co-pending U.S. patent application Ser. No. 16/248,728, filed on Jan. 15, 2019, which is incorporated herein by reference. It should be appreciated that although this disclosure describes the distribution manifold in the context of frac pumps, such a distribution manifold can be used with any pumping system with multiple pumps arranged in parallel and being fed from the same source.

In the illustrated embodiment, each of the main trunk lines 232 has an inlet 233, and each of the inlets 233 has a same first cross-sectional area. In the exemplary embodiment, the main trunk line 232 is a cylindrical pipe. Each of the main trunk lines 232 has the same first cross-sectional area along its entire length from an upstream end 231 at the first end of the manifold to an opposite downstream end 233. The length of each of the trunk lines may vary from the upstream end 231 to the downstream ends 233.

At the downstream end 233 of each of the trunk lines 232, a first Y connector 234 splits the respective trunk line 232 into two branch lines 236. In the exemplary embodiment, the two branch lines 236 are cylindrical pipes. The cross-sectional area of the flow entrance to the first Y-connector 234 is equal to the total cross-sectional area of the flow exits from the first Y-connector 234. Each of the branch lines 236 has a same second cross-sectional area, and the sum of the two second cross-sectional areas of the two branch lines 236 is equal to the first cross-sectional area of the main trunk line 232 from which the two branch lines 236 split. Each of the two branch lines 236 has the same second cross-sectional area along its entire length from an upstream end 235 at the first Y connector 234 to an opposite downstream end 237. The length of each of the two branch lines 236 may vary from the upstream end 235 to the downstream ends 237. It should be understood that although the exemplary embodiment described herein includes branch lines 236 having the same cross-sectional area, it some aspects, the branch lines 236 may have different cross-sectional areas as long as the total cross-sectional area of the branch lines equals the cross-sectional area of the trunk. That is, the total cross-sectional area remains the same at each step as flow proceeds down the manifold 200.

At the downstream ends 237, of each of the two branch lines 236, a second Y connector 238 splits the respective branch line 236 into two sub-branch lines 240. In the exemplary embodiment, the two sub-branch lines 240 are cylindrical pipes. The cross-sectional area of the flow entrance to the second Y-connector 238 is equal to the total cross-sectional area of the flow exits from the second Y-connector 238. Each of the sub-branch lines 240 has a same third cross-sectional area, and the sum of the two third cross-sectional areas of the two sub-branch lines 240 is equal to the second cross-sectional area of the respective branch line 236 from which the sub-branch lines 240 split. Also, the total cross-sectional area of the four sub-branch lines 240 that split from a single main trunk line 232 is equal to the cross-sectional area of the main trunk line 232. Each of the two sub-branch lines 240 has the same second cross-sectional area along its entire length from an upstream end 239 at the second Y connector 238 to an opposite downstream end 241. The length of each of the two sub-branch lines 240 may vary from the upstream end 239 to the downstream ends 241. It should be understood that although the exemplary embodiment described herein includes sub-branch lines 240 having the same cross-sectional area, it some aspects, the sub branch lines 240 may have different cross-sectional areas as long as the total cross-sectional area of the sub-branch lines equals the cross-sectional area of the branch line. That is, the total cross-sectional area remains the same at each step as flow proceeds down the manifold.

Each of the sub-branch lines 240 includes a port 242 at its downstream end 241 that is properly sized to match the suction (or inlet) port size of the system pumps 290 without restricting flow. One or more of the main trunk line 232, the two branch lines 236, and the four sub-branch lines 240 of the subsystems 230*a*, 230*b*, 230*c*, 230*d* may include an elbow of not greater than 45-degrees to redirect flow to a desired location at the well site. Similarly, the first and second Y connectors 234, 238 do not introduce bends of greater than 45-degrees relative to the direction of the line that feeds the respective connector 234, 238.

Figure 4:
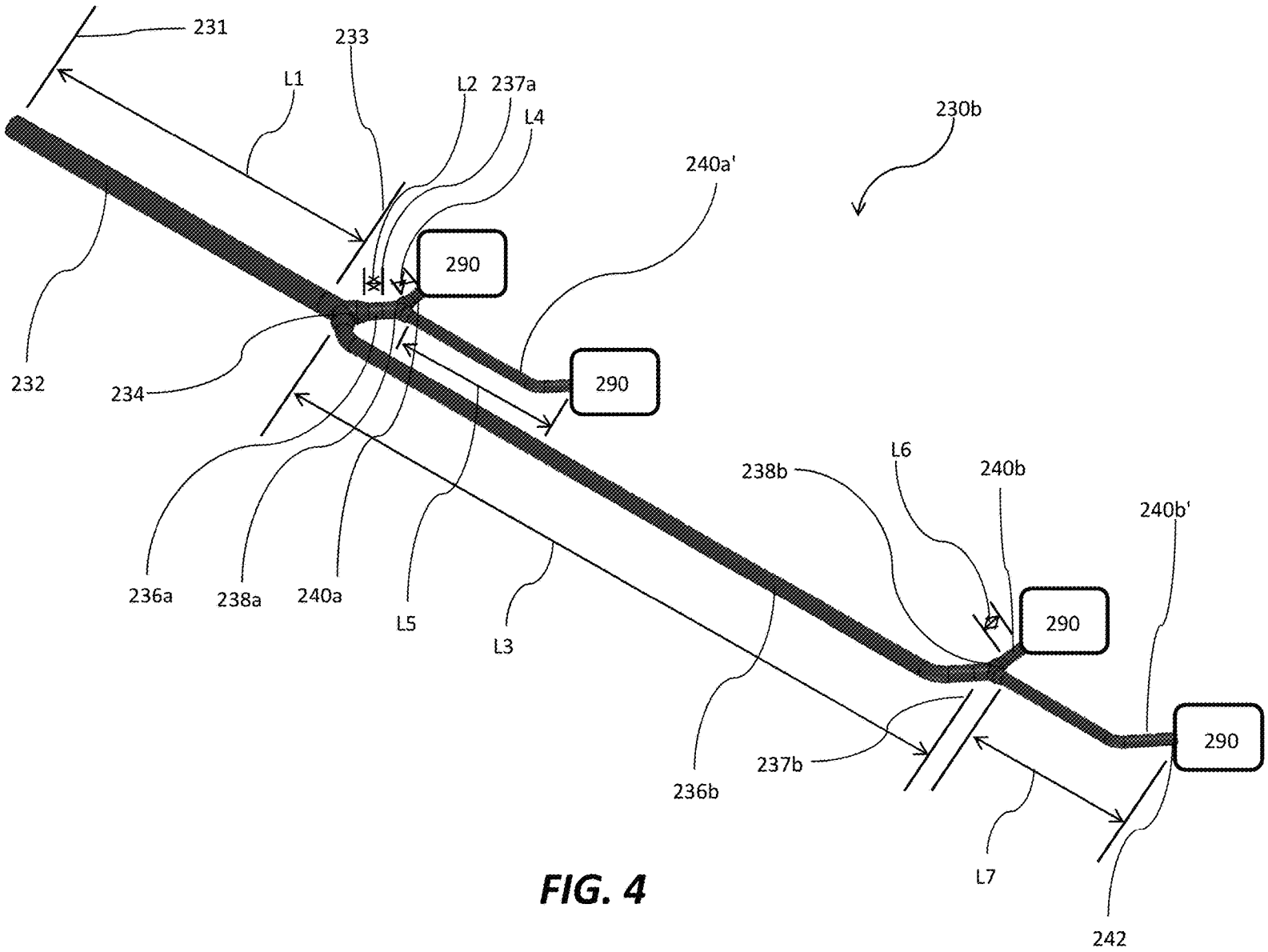
FIG. 4 is a perspective view of one of the 4-pump subsystems of the distribution manifold of FIG. 2

Referring now to FIG. 4, the 4-pump subsystem 230*b* is illustrated. The subsystem 230*b* begins with the main trunk line 232 at the first end of the manifold proximate the boost pump 205. The inlet 233 of the main trunk line 232 has the first cross-sectional area, and the main trunk line 232 has a first length L1 that extends from the upstream end 231 to the downstream end 233 of the main trunk line 232.

At the downstream end 233 of the trunk line 232, the first Y connector 234 splits the trunk line 232 into the two branch lines 236. A first one 236*a* of the branch lines has a length L2 and the second one 236*b* of the branch lines has a length L3. Each of the two branch lines 236*a*, 236*b* has the same second cross-sectional area along its entire length L2, L3, and the sum of the two second cross-sectional areas of the two branch lines 236*a*, 236*b* is equal to the first cross-sectional area of the main trunk line 232.

At the downstream end 237*a*, 237*b* of each of the two branch lines 236*a*, 236*b*, a second Y connector 238*a*, 238*b* splits the respective branch line 236*a*, 236*b* into two sub-branch lines 240. A first one 240*a* of the sub-branch lines has a length L4, a second one 240*a*' of the sub-branch lines has a length L5, a third one 240*b* of the sub-branch lines has a length L6, and a fourth one 240*b*' of the sub-branch lines has a length L7. Each of the sub-branch lines 240*a*, 240*a*', 240*b*, 240*b*' has the same third cross-sectional area along its entire length L4, L5, L6, L7. The sum of the two third cross-sectional areas of the two sub-branch lines 240*a*, 240*a*' is equal to the second cross-sectional area of the branch line 236*a*, and the sum of the two third cross-sectional areas of the two sub-branch lines 240*b*, 240*b*' is equal to the second cross-sectional area of the branch line 236*b*. Also, the total cross-sectional area of the four sub-branch lines 240*a*, 240*a*', 240*b*, 240*b*' is equal to the cross-sectional area of the main trunk line 232.

Each of the sub-branch lines 240*a*, 240*a*', 240*b*, 240*b*' includes a port 242 at its downstream end 241 that is properly sized to match the suction (or inlet) port size of the system pumps 290 without restricting flow. One or more of the main trunk line 232, the two branch lines 236*a*, 236*b*, and the four sub-branch lines 240*a*, 240*a*', 240*b*, 240*b*' of the subsystem 230*b* may include an elbow of not greater than 45-degrees to redirect flow to a desired location at the well site. Similarly, the first and second Y connectors 234, 238 do not introduce bends of greater than 45-degrees relative to the direction of the line that feeds the respective connector 234, 238.

As would be understood by persons skilled in the art, it is desirable to maintain the fluid velocity through the manifold 200 and into the pumps 290 within a desired range that is greater than a fallout velocity where proppant material (e.g., sand) falls out of suspension with the fluid and less than an erosional velocity that overdrives the piping system and causes excess erosion and risk of cavitation. That is, when fluid flow through the manifold 200 and into the pumps 290 is too low, the sand falls out. When fluid flow is too fast, it overdrives the piping system and causes excess erosion and risk of cavitation. In the above described embodiment, the distribution manifold 200 is configured to maintain a constant total cross-section and thus constant velocity throughout, thus minimizing the risk of proppant fallout and non-uniform system pump suction conditions. Computational fluid dynamics simulation and physical field testing with instrumentation have shown this manifold to create a much more uniform pressure and flow condition at each of the system pump ports 242 than the traditional manifold, which suffered a large decrease in pressure and velocity at the downstream pump port locations.

Further, the process of operating the system pumps to achieve the total desired slurry flow rate and pressure has traditionally been a highly manual task. A site operator sets the RPM and gear of each system pump independently, and makes judgments about how to run each pump based on the total flow rate required and his or her knowledge of each pump's condition and its position on the conventional distribution manifold. This manual process leads to relatively haphazard and inefficient operation, often with a small subset of the system pumps carrying a disproportionate amount of load, and thus suffering a disproportionate amount of damage. Because the inlet conditions for each system pump were highly variable based on its position on the conventional distribution manifold, the condition of each trunk line and pump port, as well as the type and condition of each system pump, uniform operation of all pumps across the entire site has been unrealistic, and thus this manual compensation for the variation across the site has been the accepted way of operating a hydraulic fracturing pump system.

The distribution manifold 200 according to the present disclosure provides a much more uniform flow and pressure inlet condition at each system pump location, making it attainable to instrument the manifold, monitor the now-smaller variations in flow conditions at each system pump port 242, and adjust the pump RPM or gear to balance flow across the entire system pump fleet. The proposed manifold is ideally accompanied by the following real-time monitoring sensors:

- pressure and/or flow sensors at the outlet of the boost pump, to monitor distribution manifold inlet conditions;
- pressure and/or flow sensors at each system pump port to monitor system pump inlet conditions which can identify sub-optimal flow conditions or pump behavior on each manifold leg; and
- vibration sensors on each system pump to monitor pump health.

This sensorization of the distribution manifold 200 will provide a wealth of knowledge to the site operator about the overall health of all equipment involved. The role of the distribution manifold 200 in this system is to remove variability and provide more constant conditions for each system pump, making it much easier for the site operator to act on the sensor data and use manifold flow conditions as an objective function for achieving uniform, healthy pump operation across the site.

Utilizing the distribution manifold 200 of the present disclosure along with the instrumentation specified above, it is possible to implement automated control of the site. Because the distribution manifold 200 according to the present disclosure essentially removes variability and allows a much more uniform baseline flow rate and pressure between all the system pumps, it is feasible to have an automated system manage the RPM and gear of each individual system pump to fine-tune the overall site performance. By monitoring the pressure and flow conditions at each port 242, as well as the mechanical vibration of each system pump, it is possible to assess the real-time health of each pump and the distribution manifold 200 itself, and optimize the overall operation of the hydraulic fracturing site, for instance to optimize the following parameters:

- Maximize total site flow rate, thus minimizing time for job completion without risk of over-driving any particular leg of the distribution manifold and cavitating a system pump.
- Minimize total damage occurring to site equipment, thus minimizing operational cost for the same work output.
- Achieve optimal balance between system pump fuel consumption and work output, while avoiding damaging pump inlet conditions.

Additional embodiments include any one of the embodiments described above, where one or more of its components, functionalities or structures is interchanged with, replaced by or augmented by one or more of the components, functionalities, or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A hydraulic fracturing distribution manifold comprising:

a plurality of pump systems, each of the pump systems being configured to direct a flow of hydraulic fracturing fluid to a plurality of positive displacement pumps, each of the pump systems including:

a main trunk line at a first end of the manifold proximate a boost pump, the main trunk line being configured to receive the flow from the boost pump, the main trunk line having a constant first cross-sectional area from an upstream end of the main trunk line to a downstream end of the main trunk line, two branch lines at the downstream end of the main trunk line, each of the two branch lines having a constant second cross-sectional area from an upstream end of the branch line to a downstream end of the branch line, a first Y-connector coupling the upstream ends of the two branch lines to the downstream end of the main trunk line, the first Y-connector being configured to split the flow from the main trunk line to the two branch lines, two sub-branch lines at the downstream end of each of the two branch lines to for four sub-branch lines, each of the four sub-branch lines having a constant third cross-sectional area from an upstream end of the sub-branch line to a downstream end of the sub-branch line, each of the sub-branch lines being configured to direct the flow to one of the positive displacement pumps, and two second Y-connectors coupling the upstream ends of the four sub-branch lines to the downstream ends of the two respective branch lines, each of the second Y-connectors being configured to split the flow from one of the two branch lines to two of the four sub-branch lines, wherein a sum of the third cross-sectional areas is equal to a sum of the two second cross-sectional areas and to the first cross-sectional area.

2. The manifold of claim 1, wherein a length of the main trunk line of one of the plurality of pump systems is different from a length of a main trunk line of another one of the plurality of pump systems.

3. The manifold of claim 1, wherein a length of a first one of the two branch lines is different from a length of a second one of the two branch lines.

4. The manifold of claim 1, wherein a length of a first one of the four sub-branch lines is different from a length of at least one other one of the four sub-branch lines.

5. A distribution manifold comprising:

a main trunk line at a first end of the manifold proximate a boost pump, the main trunk line being configured to receive a flow from the boost pump;

two branch lines at a downstream end of the main trunk line;

a first Y-connector coupling the two branch lines to the downstream end of the main trunk line, the first Y-connector being configured to split the flow from the main trunk line to the two branch lines;

two sub-branch lines at a downstream end of each of the two branch lines to form four sub-branches lines, each of the sub-branch lines being configured to direct the flow to one of a plurality of pumps; and two second Y-connectors coupling the four sub-branch lines to the downstream ends of the two respective branch lines, the second Y-connector being configured to split the flow from one of the two branch lines to two of the four sub-branch lines, wherein the main trunk line has a cross-sectional area that is constant from an upstream end of the main trunk line to the downstream end of the main trunk line, wherein the two branch lines have a total cross-sectional area that is constant from an upstream end of each of the two branch lines to the downstream end of each of the two branch lines, wherein the four sub-branch lines have a total cross-sectional area that is constant from an upstream end of each of the four sub-branch lines to a downstream end of each of the four sub-branch lines, and wherein the total cross-sectional area of the four sub-branch lines, the total cross-sectional area of the two branch lines, and the cross-sectional area of the main trunk line are equal to one another.

6. The manifold of claim 5, wherein a length of the main trunk line of one of the plurality of pump systems is different from a length of a main trunk line of another one of the plurality of pump systems.

7. The manifold of claim 5, wherein a length of a first one of the two branch lines is different from a length of a second one of the two branch lines.

8. The manifold of claim 5, wherein a length of a first one of the four sub-branch lines is different from a length of at least one other one of the four sub-branch lines.

9. A distribution manifold comprising:

a main trunk line at a first end of the manifold proximate a boost pump, the main trunk line being configured to receive a flow of fluid from the boost pump, an upstream end of the main trunk line having a cross-sectional area;

two branch lines at a downstream end of the main trunk line;

a first Y-connector coupling upstream ends of the two branch lines to the downstream end of the main trunk line, the first Y-connector being configured to split the flow from the main trunk line to the two branch lines;

two sub-branch lines at a downstream end of each of the two branch lines to form four sub-branch lines, each of the sub-branch lines being configured to direct the flow to one of a plurality of pumps; and two second Y-connectors coupling upstream ends of the four sub-branch lines to the downstream ends of the two respective branch lines, each of the second Y-connectors being configured to split the flow from one the two branch lines to two of the four sub-branch lines, wherein a sum of cross-sectional areas of downstream ends of the four sub-branch lines is equal to the cross-sectional area of the upstream end of the main trunk line.

10. The manifold of claim 9, wherein a sum of cross-sectional areas of the upstream ends of the two branch lines is equal to the cross-sectional area of the upstream end of the main trunk line.

11. The manifold of claim 10, wherein a sum of cross-sectional areas of the downstream ends of the two branch lines is equal to a sum of cross-sectional areas of upstream ends of the four sub-branch lines.

12. The manifold of claim 9, wherein the main trunk line has a cross-sectional area that is constant from the upstream end of the main trunk line the downstream end of the main trunk line.

13. The manifold of claim 9, wherein the two branch lines have a total cross-sectional area that is constant from the upstream end of each of the two branch lines to the downstream end of each of the two branch lines.

14. The manifold of claim 9, wherein the four sub-branch lines have a total cross-sectional area that is constant from the upstream end of each of the four sub-branch lines to the downstream end of each of the four sub-branch lines.

15. The manifold of claim 9, wherein the main trunk line has a cross-sectional area that is constant from the upstream end of the main trunk line to the downstream end of the main trunk line, wherein the two branch lines have a total cross-sectional area that is constant from the upstream end of each of the two branch lines to the downstream end of each of the two branch lines, wherein the four sub-branch lines have a total cross-sectional area that is constant from the upstream end of each of the four sub-branch lines to the downstream end of each of the four sub-branch lines, and wherein the total cross-sectional area of the four sub-branch lines, the total cross-sectional area of the two branch lines, and the cross-sectional area of the main trunk line are equal to one another.

16. The manifold of claim 9, wherein a length of the main trunk line of one of a plurality of pump systems is different from a length of a main trunk line of another one of the plurality of pump systems.

17. The manifold of claim 9, wherein a length of a first one of the two branch lines is different from a length of a second one of the two branch lines.

18. The manifold of claim 9, wherein a length of a first one of the four sub-branch lines is different from a length of at least one other one of the four sub-branch lines.

* * * * *